United States Patent [19]

Osborn et al.

[11] Patent Number: 4,688,459

[45] Date of Patent: Aug. 25, 1987

[54] PUNCH RETAINING DEVICE

[75] Inventors: Wayne L. Osborn; Monty L. Neff, both of Emporia, Kans.

[73] Assignee: Didde Graphics Systems Corp., Emporia, Kans.

[21] Appl. No.: 797,842

[22] Filed: Nov. 14, 1985

[51] Int. Cl.[4] ..... B26F 1/08; B26F 1/14

[52] U.S. Cl. ..... 83/698; 279/97

[58] Field of Search ..... 83/698; 279/1 B, 97, 279/76, 79, 86, 87

[56] References Cited

U.S. PATENT DOCUMENTS

| | | | |
|---|---|---|---|
| 95,060 | 9/1869 | Winkelhouse | 279/97 |
| 1,785,495 | 12/1930 | Richard . | |
| 1,809,823 | 6/1931 | Altvater | 279/76 |
| 1,833,236 | 11/1931 | Smith | 279/97 |
| 2,844,378 | 7/1958 | Whistler et al. | 279/97 |
| 3,640,170 | 2/1972 | Bennett | 83/698 |
| 3,828,632 | 8/1974 | Grano | 83/345 |
| 4,096,776 | 6/1978 | Laucke | 83/698 |
| 4,174,648 | 11/1979 | Wallis | 83/698 |
| 4,284,284 | 8/1981 | Sides | 279/97 X |

*Primary Examiner*—James M. Meister

*Attorney, Agent, or Firm*—Schmidt, Johnson, Hovey & Williams

[57] ABSTRACT

A punch assembly is provided wherein individual punches may be quickly released and extracted from a punch ring by depressing an elongated retainer member positioned adjacent and transverse to each of the punches. The retainer member has walls defining a concave groove, and the retainer walls are selectively engageable with complemental, groove-defining walls of each punch. A spring normally biases the retainer member to a position where the retainer walls tightly engage the punch walls and thereby retain the punch within a bore of the punch ring. When the punch must be removed from the ring for repair or replacement, the retainer can be depressed against the bias of the spring and shifted to a position wherein the groove-defining retainer walls disengage the groove-defining punch walls, thereby enabling the release of the punch from the punch ring.

6 Claims, 6 Drawing Figures

PUNCH RETAINING DEVICE

BACKGROUND OF THE INVENTION

1. Field of the Invention

This invention relates to a retainer for releasably securing a punch within a bore of a punch ring, wherein the retainer is in the nature of a hand operable, elongated member that is selectively shiftable for releasing the punch from the ring.

2. Description of the Prior Art

Web fed printing presses commonly incorporate a punching system for forming a repetitive series of holes in the web as the latter is advanced. Typically, such punching systems have a spaced series of punches secured to a shaft-mounted punch ring and a mating die ring having a series of dies, wherein the die ring is secured to a second shaft in spaced, parallel disposition to the punch ring shaft. As the web is advanced toward the gap between the punch ring and the adjacent die ring, the punch ring and the die ring simultaneously counter-rotate so that a piercing end of each punch registers with a respective die hole in the die ring and thereby simultaneously perforates the advancing web.

As is known, the piercing end of the individual punches is subject to wear, breakage and other damage during operation of the press such that replacement of the individual punches is required at relatively frequent intervals. As an example, such punches often last only about two weeks if the punching system is in continuous use. At the same time, the press might be provided with two or four 22" punch rings, wherein each of the rings carries forty-four punches. As can be appreciated, such a multitude of punches would desirably be secured to the punch ring in a manner such that removal and replacement can be accomplished within a short period of time.

In the past, various means have been proposed for releasably securing a punch to a punch ring or other support. One such method utilizes a set screw threaded through the punch ring that bears against the side of the punch. A related method is shown in U.S. Pat. No. 4,096,776 to Laucke, dated June 27, 1978, wherein a threaded pin retainer has a tapered section that is engageable with tapered grooves on a punch shank, and wherein a tool such as an allen wrench can be utilized for retractably rotating the pin retainer in order that the punch may be extracted from its support.

Other types of punch retaining devices are shown in U.S. Pat. No. 1,785,795 to Richard, dated Dec. 16, 1930 and U.S. Pat. No. 3,640,170 to Bennett, dated Feb. 8, 1972. Both of these references disclose the concept of a rotatable punch holding member having wall structure selectively engageable with a notch on a punch shank. By use of a wrench or lever, the punch holding member can be rotated to a position wherein the wall structure disengages the punch so that the latter may then be removed from the punch ring or other support.

Another type of punch retaining device is illustrated in U.S. Pat. No. 3,828,632 to Grano, dated Aug. 13, 1974, wherein is shown a spring loaded ball mounted within the punch ring and biased toward a peripheral groove of an adjacent punch shank. However, such structure is not entirely satisfactory since a tool must be utilized to grasp the punch head to exert a camming force on the ball against the compression of the spring so that the punch can be extracted from the punch ring. Moreover, dirt and metallic particles often accumulate in the area in the vicinity of the ball whereby movement of the latter and extraction of the punch is substantially hindered.

Thus, it would be a desirable advance in the art if means were devised to releasably secure a punch to a punch ring without the necessity of using tools or the like for removing the punch when necessary. Moreover, it is preferable that each of the individual punches can be separately removed without disturbing adjacent punches. In addition, such a retaining device must be operable to tightly secure the punch to the ring during operation of the press and withstand the outwardly directed force tending to pull the punch from the ring as the punch is withdrawn after the working stroke.

SUMMARY OF THE INVENTION

The present invention overcomes the disadvantages of the prior art by provision of structure that is operable to instantly release the punch without the use of tools or wrenches. As a result, replacement and removal of the individual punches is greatly facilitated.

In more detail, the punch assembly of the present invention comprises an elongated punch slidably received within a bore of a punch ring, and an elongated, generally cylindrical retainer member slidably carried by the punch ring in a second bore orthogonally disposed relative to the punch bore. The retainer member has walls defining a peripheral, concave groove, and the walls are complementally engageable with structure on the punch defining a peripheral punch groove. The retainer member is shiftable between a first position wherein the member walls securely engage the punch to retain the latter in the punch ring and a second position wherein the member walls disengage the groove-defining punch structure so that the punch may thereby be extracted from the punch ring.

In preferred forms of the invention, the retainer member protrudes outwardly from the punch ring and presents a head in the nature of a button which may be depressed by hand to shift the retainer member toward the second, punch releasing position. At the same time, a compression spring surrounding the retainer member yieldably biases the latter toward the first, punch securing position. Thus, in use, each individual punch may be quickly released from the punch ring by depressing a respective retainer member.

Advantageously, the punch groove-defining structure as well as the retainer member groove-defining walls are of a conical configuration and configured such that the bias presented by the spring normally retains the inner end of the punch in firm, seating engagement with the bottom of the punch bore. As a result, during rotation of the ring, free play of the punch is eliminated in order to reduce wear and deterioration of the latter.

DETAILED DESCRIPTION OF THE DRAWINGS

Figure 1:
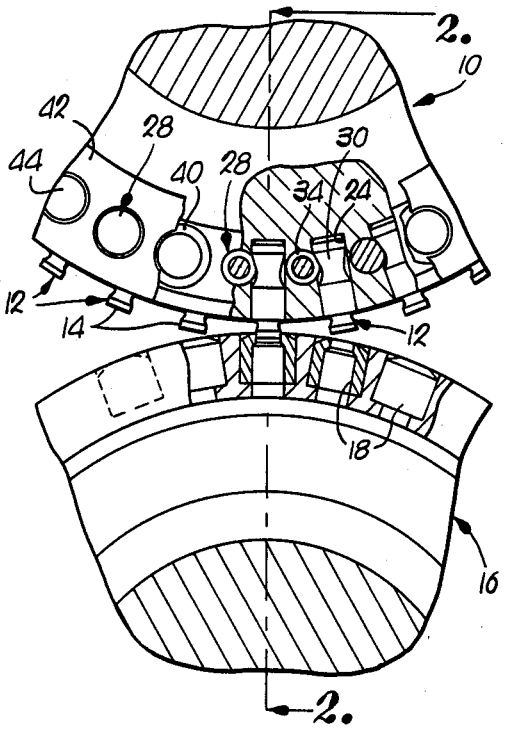
FIG. 1 is a fragmentary, side elevational view of the punch ring and die ring with parts broken away for clarity, wherein the punch retaining device of the instant invention releasably secures individual punches to the punch ring.
Figure 2:
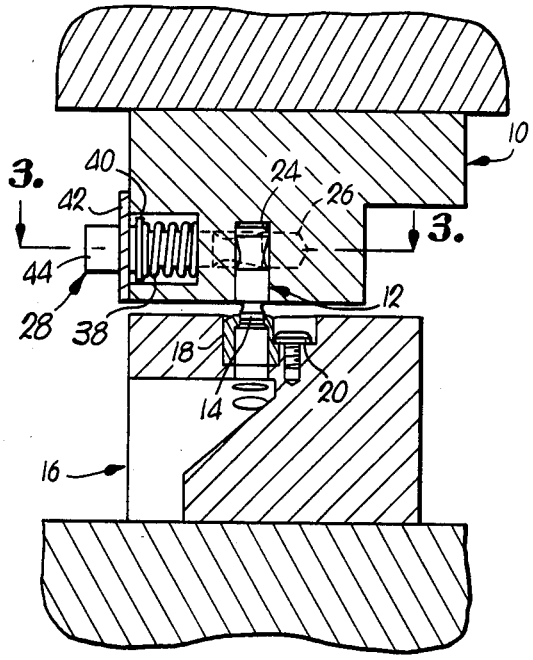
FIG. 2 is a fragmentary, side cross-sectional view taken substantially along line 2—2 of FIG. 1, depicting part of the retaining member in dashed lines.
Figure 5:
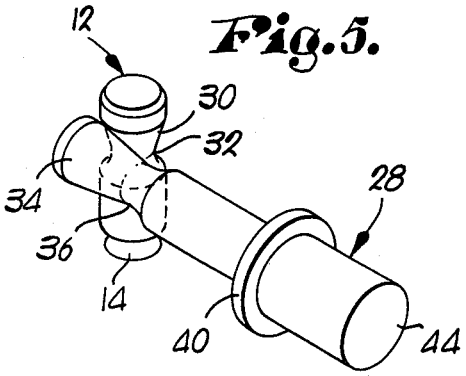
FIG. 5 is an enlarged, perspective view of the retainer member and punch of the instant invention, showing the complemental relationship between the retainer member groove and the punch groove.

Referring initially to FIGS. 1–2, a support or punch ring 10 is shown which carries a plurality of radially-extending, spaced punches 12 each having an outwardmost piercing end 14. A die ring 16 supports a spaced series of dies 18 that are each releasably affixed to the die ring 16 by means of individual screws 20 (see FIG. 2). The punch ring 10 and the die ring 16 are counter-rotatable around spaced parallel axes, and the punches 12 are aligned with the dies 18 such that as a web (not shown) is advanced through the gap between the counter-rotating rings 10, 16, each of the punches 12 serially protrudes into the respective die 18 and simultaneously punches the web.

Viewing FIGS. 1–4 and 6, the support or punch ring 10 has a plurality of elongated first bores 24 for slidably receiving the generally cylindrical, elongated punches 12. Additionally, the punch ring 10 has a plurality of elongated second bores 26, each of which slidably receives a generally cylindrical, elongated retainer member 28. As shown, the longitudinal axis of each of the second bores 26 is perpendicular and adjacent to the longitudinal axis of each respective first bore 24.

Each of the punches 12 has structure or walls 30 defining a concave, peripheral groove 32 disposed along an axis transverse to the longitudinal axis of the punch 12. Additionally, each of the retainer members 28 has walls 34 defining a concave, peripheral groove 36 disposed along an axis transverse to the longitudinal axis of the retainer member 28. As illustrated, the walls 30, 34 include generally conical portions.

Figure 3:
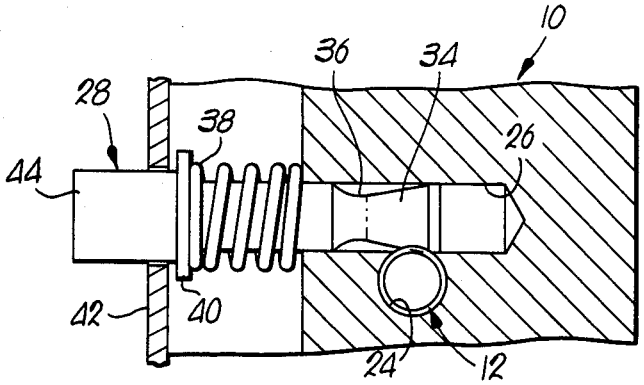
FIG. 3 is an enlarged, fragmentary, cross-sectional view taken along line 3—3 of FIG. 2, illustrating the relationship of the punch retaining member to the transversely mounted punch.
Figure 6:
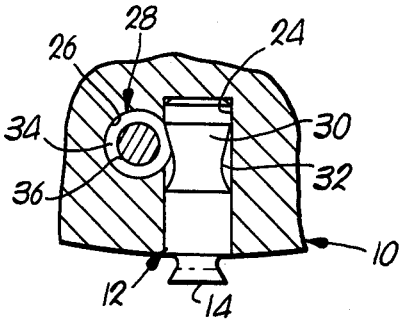
FIG. 6 is a fragmentary, enlarged, sectional view of the punch received in the bore of the punch ring and retained in operating position by the retainer member of the instant invention.
Figure 4:
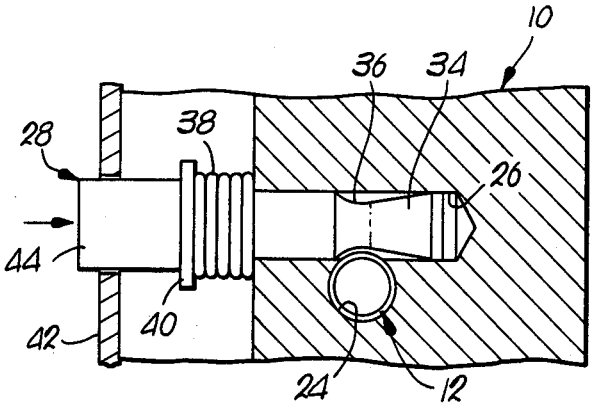
FIG. 4 is a view similar to FIG. 3 wherein the retainer member has been depressed in order to disengage the groove-defining walls of the retainer member from the groove-defining structure of the punch and thereby enable extraction of the punch.

The retainer member 28 is shiftable between a first or outwardmost position relative to the ring 10, as shown in FIG. 3, and a second or inwardmost position relative to the ring 10, as illustrated in FIG. 4. When the member 28 is in the first position, the walls 34 are complementally engageable with the structure 30 defining the punch groove 32 and are configured for securing the punch 12 to the ring 10 in a position abutting the bottom of the first bore 24 (see FIG. 6). Loose movement or slop of the punch 12 within the bore 24 is minimized due to the fact that as the punch 12 engages the bottom of the bore 24, the bottom of the groove 32 is offset from the bottom of the groove 36.

Viewing FIG. 4, when the retainer member 28 is shifted to its second position, the retainer walls 34 are configured to disengage the punch walls 30 and thereby enable release of the punch 12 from its respective bore 24. The groove 36 is shaped to clear the punch walls 30 as well as the remaining, inwardmost portions of the punch 12 when the member 28 is in its second position in order to facilitate extraction of the punch 12.

Referring to FIGS. 2–4, a means yieldably biasing the retainer member 28 toward the first position comprises a compression spring 38 surrounding the member 28 between the punch ring 10 and an outwardly extending flange 40 integral with the retainer member 28. An annular, generally flat plate 42 (see FIG. 1) releasably fixed to the punch ring 10 has a spaced series of apertures for receiving a button-like, head portion 44 of each of the retainer members 28. As depicted in FIGS. 2–4, the diameter of the flange 40 is somewhat larger than the apertures in the plate 42 for securely retaining the members 28 in their respective bores 26.

As can now be appreciated by those skilled in the art, the perpendicular and offset disposition of the member 28 relative to its respective punch 12 enables the retainer walls 34 to securely engage the punch walls 30 and retain the punch 12 in its corresponding bore 24. At the same time, release of the punch 12 can be quickly accomplished by the user by depressing the head portion 44 with a finger and shifting the member 28 in the direction of the arrow shown in FIG. 4, in order that the retainer walls 34 move to a position to clear the punch walls 30.

Thus, the punch assembly of the instant invention, including the punches 12 in cooperation with the retainer members 28, provides a means for quickly releasing individual punches 12 from their bores 24 for replacement or repair. Furthermore, replacement can be accomplished in a minimum of time such that labor costs are substantially reduced. If necessary, the members 28, including the springs 38 may be easily repaired or replaced by removal of the plate 42 from the punch ring 10.

We claim:

1. A punch assembly comprising:

a support with an elongated first bore and a second bore having a longitudinal axis generally perpendicular to the longitudinal axis of said first bore;

an elongated punch releasably carried by said support in said first bore and having structure defining a peripheral groove disposed substantially along an axis transverse to the longitudinal axis of said punch;

a retainer member slidably carried by said support and received in said second bore adjacent said punch and having means adapted for engagement with a hand for shifting said member along an axis generally perpendicular to the longitudinal axis of said punch between a first position and a second position, said retainer member having walls complementally engageable with said structure defining said punch groove when said member is in said first position for selectively securing said punch to said support, said walls being configured for disengaging said groove-defining structure when said member is shifted by said hand toward said second position and thereby enabling release of said punch from said support;

means yieldably biasing said member toward said first position; and a plate releasably coupled to said support, said member being provided with an outwardly extending flange engageable with said plate for retaining said member in said second bore.

2. The invention of claim 1, wherein said biasing means comprises a compression spring surrounding said member between said flange and said support.

3. A punch assembly comprising:

a support having an elongated first bore and a second bore having a longitudinal axis generally perpendicular to said first bore, said support including stop means disposed in said first bore;

an elongated punch received in said first bore and longitudinally shiftable along the longitudinal axis of said first bore, said punch having an end segment;

an elongated retainer member received in said second bore and longitudinally shiftable along the longitudinal axis of said second bore; and means for securely and releasably retaining said end segment of said punch in a fixed position in abutting contact with said stop means, said retaining means including means yieldably biasing said retainer member in a certain longitudinal direction;

walls of said retainer member defining a portion tapering outwardly from the longitudinal axis of said retainer member as said member is approached in a direction opposite to said certain longitudinal direction; and structure of said punch defining a portion tapering outwardly from the longitudinal axis of said punch as said punch end segment is approached, said retainer member being selectively shiftable against the bias of said biasing means to move said tapering portion of said retainer member to a position clearing said tapering portion of said punch to enable release of the latter from said first bore, said biasing means normally urging said retainer member in said certain longitudinal direction to bring said outwardly tapering wall portion of said retainer member into engagement with said outwardly tapering portion of said punch, and thereby shift said punch end segment into a position of abutting contact with said stop means, said tapering portion of said retainer member thereafter continuing to engage said tapering portion of said punch as said biasing means continues to urge said retainer member in said certain longitudinal direction so that vibrations and the like experienced by said punch assembly during use of the latter further urge said retainer member in said certain longitudinal direction and tighten said tapering portion of said retainer member against said tapering portion of said punch, causing said end segment of said punch to be fixedly retained against said stop means regardless of small tolerances in dimension of said punch, said first bore and said retainer member.

4. The invention as set forth in claim 3, wherein said retainer member and said punch are generally cylindrical, said tapering wall portion of said retainer member comprises part of a circumscribing groove of said retainer member, and said tapering portion of said punch comprises part of a circumscribing groove of said punch.

5. The invention as set forth in claim 4, wherein said tapering portion of said punch and said tapering portion of said retainer member each have a conical configuration.

6. The invention as set forth in claim 3, wherein said retainer member has a head portion engageable with the hand for shifting said member in a longitudinal direction against the bias presented by said biasing means.

* * * * *